United States Patent [19]

Brunner et al.

[11] Patent Number: 4,472,298

[45] Date of Patent: Sep. 18, 1984

[54] PROCESS FOR EMBEDDING RADIOACTIVE, ESPECIALLY TRITIUM CONTAINING WASTE

[75] Inventors: Herbert Brunner, Hanau; Horst Vietzke, Maintal, both of Fed. Rep. of Germany

[73] Assignee: Nukem GmbH, Hanau, Fed. Rep. of Germany

[21] Appl. No.: 263,704

[22] Filed: May 14, 1981

[30] Foreign Application Priority Data

May 16, 1980 [DE] Fed. Rep. of Germany ..... 3018746

[51] Int. Cl.[3] ..... G21F 9/16; G21F 9/34

[52] U.S. Cl. ..... 252/628; 252/633

[58] Field of Search ..... 252/628, 633

[56] References Cited

U.S. PATENT DOCUMENTS 4,115,311 9/1978 Sump ..... 252/628

4,280,921 7/1981 May ..... 252/628

FOREIGN PATENT DOCUMENTS 130798 11/1979 Japan ..... 252/628

WO80/01217 6/1980 PCT Int'l Appl. .

1446016 8/1976 United Kingdom ..... 252/628

2041912 9/1980 United Kingdom .

*Primary Examiner*—Brooks H. Hunt

*Attorney, Agent, or Firm*—Cushman, Darby & Cushman

[57] ABSTRACT

Radioactive, particularly tritium containing, waste must be stored in such manner that the environment is not endangered. This is done by conditioning the waste and embedding it in concrete whereby a central temperature of the product of 90°–95° C. must not be exceeded and therewith a dilution is necessary. These difficulties are overcome by inserting the waste in a metal matrix so that the waste is pressed with a metal powder at room temperature to molded bodies.

6 Claims, No Drawings

PROCESS FOR EMBEDDING RADIOACTIVE, ESPECIALLY TRITIUM CONTAINING WASTE

BACKGROUND OF THE INVENTION

The invention is directed to a process for embedding highly and average active, especially tritium containing, granular and lumpy solid waste in a metal matrix for the purpose of final storage.

In the operation of nuclear reactors and other industrial nuclear plants, particularly in the reprocessing of spent fuel elements from light water reactors, there accumulates high or average active solid wastes, for example, scrap, apparatus parts, fuel element top and bottom pieces, fuel element jackets, spacers, springs, bolts, and other small parts which must be conditioned and stored in such manner that the environment is not endangered.

According to the present state of the art, this is made possible by embedding the radioactive solid waste in concrete and later intercalation in a suitable geological formation.

Average and high active waste products for this purpose must be conditioned and stored in such manner that the central temperature of the product does not exceed 90°–95° C. The dilution of the waste necessary for this and the increase of the storage volume obtained is disadvantageous for the covering with concrete. A further disadvantage is that tritium can be set free from the concrete covered solid wastes, particularly from fuel element jackets.

From the German OS Nos. 26 28 144 and 2 717 389, there are known processes which embed the waste in a metal matrix. The embedding takes place by filling the hollow space between the solid wastes with a molten metal consisting of aluminum or low melting metals such as lead, tin, zinc, copper, or metal alloys.

It is also known, e.g., to embed fuel element jackets in glass or by melting radioactive solid waste with additives to solidify it to a compact block.

All of these processes have the disadvantage that by the use of elevated temperatures during the solidification processes there are set free volatile radio-nuclides as, e.g., tritium or ruthenium which are separated from the waste gas and must be separately eliminated.

Therefore, it was the problem of the invention to develop a process for embedding radioactive wastes in a metal matrix in which no elevated processing temperatures need be used and in which simultaneously the thermal conductivity and the ability of the final product to retain tritium is improved, and the leaching out of radionuclides is reduced in case of accident.

SUMMARY OF THE INVENTION

This problem was solved according to the invention by pressing the waste with a metal powder at room temperature to molded bodies. These molded bodies are advantageously inserted in final storage containers, preferably stainless steel cans as are used for radioactive glass and ceramic waste products. It is particularly advantageous to produce a compact block by repeated forcing of solid waste and metal powder into the final storage container, which block is in tight contact with the wall of the final storage container and, therefore, effects a good conductance of heat.

The cold forming by pressing is possible with almost all metal powders, e.g., those mentioned above. Therefore, the composition of the metallic matrix can be adjusted according to each condition of use with consideration of the type of waste and waste composition, type of final storage and geological formation as well as in regard to optimization of product properties relevant to accidents. For the solidification in regard to retaining tritium, there are particularly well suited aluminum or corrosion resistant AlMg alloys.

A further advantage of the pressing process is that the barrier function of the final storage container can be improved in an advantageous manner. By using inner containers or inner coatings of materials adjusted to each case of use with subsequent cold forming, there can be produced a homogeneous union without fissures and gaps between the waste product and the wall of the container. The setting free of tritium above all is further reduced by an additional aluminum coating on the container, which prevents leaching of the final product by water or corrosive lye in case of accident. In this manner, there can be produced embeddings with 2–4 barriers in a simple manner.

Unless otherwise indicated, all parts and percentages are by weight.

The process can comprise, consist essentially of, or consist of the steps set forth with the stated materials.

The following examples further illustrate the process of the invention.

DETAILED DESCRIPTION

Example 1

Precompacted fuel element jacket pieces about 50 mm long served as simulated waste, binder was aluminum powder. For the production of the molded body, there was present aluminum powder, subsequently fuel element jacket pieces distributed in a layer on the ballast, covered with powder and precompressed by light pressing. After several repetitions of this process, the molded bodies were finally compressed at a specific pressure of 5–6 Mp/cm$^2$. After the finishing, the moldings had the following properties:

Waste loading: 57 weight %

Density: 4.3 g/cm$^3$

By increasing the number of layers, the waste treatment can be further enhanced, consequently the necessary amount of binder is reduced.

Example 2

Comminuted pieces of scrap having a maximum length of side of 10 cm were filled with stainless steel powder into a steel container (300 mm diameter), preliminarily pressed in layers and subsequently conditioned by cold forming at 5–6 Mp/cm$^2$. By the pressing, there was obtained a fissure free union of container and product. After the finishing, the moldings had the following properties:

Waste loading: 57 weight %

Density: 7.7 g/cm$^3$

Room temperature is normally about 20° C.

What is claimed is:

1. A process for embedding radioactive, granular, or lumpy waste which contains trituim in a metallic matrix, comprising precompressing the waste with a metal powder by light pressing at room temperature and then pressing the precompressed waste and metal powder at 5–6 Mp/cm$^2$ and room temperature to a molded body, carrying out the pressing by repeatedly pressing the radioactive waste and metal into a final storage container and producing a compact block in tight contact with the wall of the container.

2. A process according to claim 1 comprising improving the ability of the final storage container to retain the radioactive material comprising providing an inner container for the final storage container or an inner coating on the final container.

3. A process according to claim 2 wherein there is provided an aluminum or aluminium-magnesium alloy inner coating on the final storage container.

4. A process according to claim 3 wherein the metal powder is aluminum or an aluminum-magnesium alloy.

5. A process according to claim 2 wherein the metal powder is aluminum or an aluminum-magnesium alloy.

6. A process according to claim 1 wherein the metal powder is aluminum or an aluminum-magnesium alloy.

* * * * *